US007816977B2

(12) United States Patent
Shin

(10) Patent No.: US 7,816,977 B2
(45) Date of Patent: Oct. 19, 2010

(54) CORE VOLTAGE GENERATOR

(75) Inventor: Yoon-Jae Shin, Kyoungki-Do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 109 days.

(21) Appl. No.: 12/164,972

(22) Filed: Jun. 30, 2008

(65) Prior Publication Data

US 2009/0066410 A1 Mar. 12, 2009

(30) Foreign Application Priority Data

Sep. 7, 2007 (KR) ..... 10-2007-0090908

(51) Int. Cl.
*G05F 1/10* (2006.01)

(52) U.S. Cl. ..... 327/540

(58) Field of Classification Search ..... 327/540, 327/541

See application file for complete search history.

(56) References Cited

U.S. PATENT DOCUMENTS 5,352,935 A * 10/1994 Yamamura et al. ..... 327/540
7,095,272 B2 * 8/2006 Morishita ..... 327/541
7,417,494 B2 * 8/2008 Choi et al. ..... 327/541
7,432,758 B2 * 10/2008 Chou et al. ..... 327/540
7,439,798 B2 * 10/2008 Kouno et al. ..... 327/541
7,576,596 B2 * 8/2009 Lee et al. ..... 327/538

FOREIGN PATENT DOCUMENTS

KR 1019990030085 A 4/1999
KR 1020050077992 A 8/2005

OTHER PUBLICATIONS

Notice of Preliminary Rejection issued from Korean Intellectual Property Office on Jun. 30, 2009 with an English Translation.

* cited by examiner

*Primary Examiner*—Jeffrey S Zweizig
(74) *Attorney, Agent, or Firm*—IP & T Law Firm PLC

(57) ABSTRACT

Core voltage generator including a comparison unit configured to compare a reference voltage with a feedback core voltage to output a difference between the reference voltage and the feedback core voltage, an amplification unit configured to output a core voltage by amplifying an external power supply voltage according to an output signal of the comparison unit and a mute unit configured to maintain a voltage level of an output terminal of the amplification unit at a ground voltage level when the output of the core voltage is interrupted.

8 Claims, 3 Drawing Sheets

CORE VOLTAGE GENERATOR

CROSS-REFERENCE TO RELATED APPLICATIONS

The present invention claims priority of Korean patent application number 10-2007-0090908, filed on Sep. 7, 2007, which is incorporated by reference in its entirety.

BACKGROUND OF THE INVENTION

The present invention relates to a circuit design, and more particularly, to a core voltage generator for a semiconductor memory device.

Semiconductor memory devices are used for data storage in various application fields. Desktop computers, laptop computers, and other portable terminals require high-capacity, high-speed, small-sized, low-power semiconductor memory devices.

A method of minimizing current consumption at a core area of a semiconductor memory device has been introduced to provide a low-power semiconductor memory device. Memory cells, bit lines, and word lines are arranged in a core area of the semiconductor memory device, and the core area is designed based on an ultra-fine design rule. The power supply voltage level should be low for operating semiconductor memory devices having ultra-fine patterns at high frequencies.

Semiconductor memory devices are operated by an internal power supply voltage generated using an external power supply voltage. For example, a core voltage (VCORE) is used to access cell data in a dynamic random access memory (DRAM) having a bit line sense amplifier.

When a word line is activated, data stored in memory cells connected to the word line are transferred to bit lines, and bit line sense amplifiers sense and amplify voltage differences of the bit line pairs. In this way, when several thousands of bit line sense amplifiers operate simultaneously, a pull-up power supply line is used and a large amount of current is consumed thro ugh a core voltage output terminal.

FIG. 1 is a circuit diagram illustrating a conventional core voltage generator.

Referring to FIG. 1, the conventional core voltage generator includes a comparison unit 10, an amplification unit 12, and a half core voltage generation unit 14. The comparison unit 10 compares a half core voltage HF_VCORE with a reference voltage VREFC. The half core voltage HF_VCORE has half the voltage level of a core voltage output terminal, and the reference voltage VREFC has half the level of a target core voltage (1.5 V/2=0.75 V). The amplification unit 12 generates an amplified core voltage of about 1.5 V in response to an output signal of the comparison unit 10. The half core voltage generation unit 14 distributes the core voltage generated from the amplification unit 12 and generates the half core voltage HF_VCORE having half the voltage level of the core voltage output terminal so as to maintain the core voltage VCORE output from the amplification unit 12 at a desired level. The conventional core voltage generator further includes a control switch unit 16 for controlling the operation of the comparison unit 10.

The comparison unit 10 operates when a high-level active enable signal ACTIVE_ENABLE of about 0.830 V is applied to a gate terminal of an n-channel metal oxide semiconductor (NMOS) transistor MN2 of the control switch unit 16.

If the NMOS transistor MN2 is turned on by the high-level active enable signal ACTIVE_ENABLE, an NMOS transistor MN0 is turned on by the reference voltage VREFC, which is applied to the NMOS transistor MN0 from an external voltage source. Thus, drain voltages of the NMOS transistors MN0 and MN2 are reduced. That is, the voltage level of a node N1 is reduced. As a result, a low level signal is applied to a gate terminal of a p-channel metal oxide semiconductor (PMOS) transistor MP2 of the amplification unit 12 to turn on the PMOS transistor MP2. When the PMOS transistor MP2 is turned on by the low level signal, the voltage level of a core voltage VCORE output from the amplification unit 12 increases.

If the core voltage VCORE increases, the half core voltage HF_VCORE output from the half core voltage generation unit 14 also increases, and thus an NMOS transistor MN1 is turned on. Then, the voltage level of a node N2 is reduced. That is, voltage levels of gate terminals of PMOS transistors MP0 and MP1 are reduced. Therefore, the PMOS transistors MP0 and MP1 are turned on. As the PMOS transistors MP0 and MP1 are turned on, the voltage level of the node N1 gradually increases. Therefore, the voltage level of the gate terminal of the PMOS transistor MP2 gradually increases. These operations are repeated until the half core voltage HF_VCORE becomes equal to the reference voltage VREFC.

Meanwhile, when a low-level active disable signal lower than the threshold voltage of the NMOS transistor MN2 is applied to the gate terminal of the NMOS transistor MN2, the control switch unit 16 is turned off and thus the core voltage VCORE is not generated.

If the NMOS transistor MN2 is turned off by the low-level active disable signal, the NMOS transistor MN0 is also turned off because a current path is not formed through the NMOS transistor MN0. Therefore, the voltage level of the node N1 becomes high, and thus, the PMOS transistor MP2 is turned off. That is, the core voltage VCORE is not generated through node N3.

However, the conventional core voltage generator has the following limitations. Although the PMOS transistor MP2 is turned off to interrupt the core voltage VCORE, a small amount of current flows through the PMOS transistor MP2 because NMOS transistors MN3 and MN4 of the half core voltage generation unit 14 are connected between the PMOS transistor MP2 and ground. In other words, as the NMOS transistors MN3 and MN4 used for generating the half core voltage HF_VCORE at node N4 are connected between the core voltage output terminal and ground, the conventional core voltage generator consumes unnecessary power even when it does not generates the core voltage VCORE.

SUMMARY OF THE INVENTION

Embodiments of the present invention are directed to providing a core voltage generator that is capable of reducing unnecessary power consumption when it does not generates a core voltage. In accordance with an aspect of the present invention, there is provided a comparison unit configured to compare a reference voltage with a feedback core voltage to output a difference between the reference voltage and the feedback core voltage, an amplification unit configured to output a core voltage by amplifying an external power supply voltage according to an output signal of the comparison unit and a mute unit configured to maintain a voltage level of an output terminal of the amplification unit at a ground voltage level when the output of the core voltage is interrupted.

DESCRIPTION OF SPECIFIC EMBODIMENTS

Hereinafter, a core voltage generator in accordance with the present invention will be described in detail with reference to the accompanying drawings. VDD and VSS refer to drain and source voltages respectively throughout the drawings.

Figure 2:
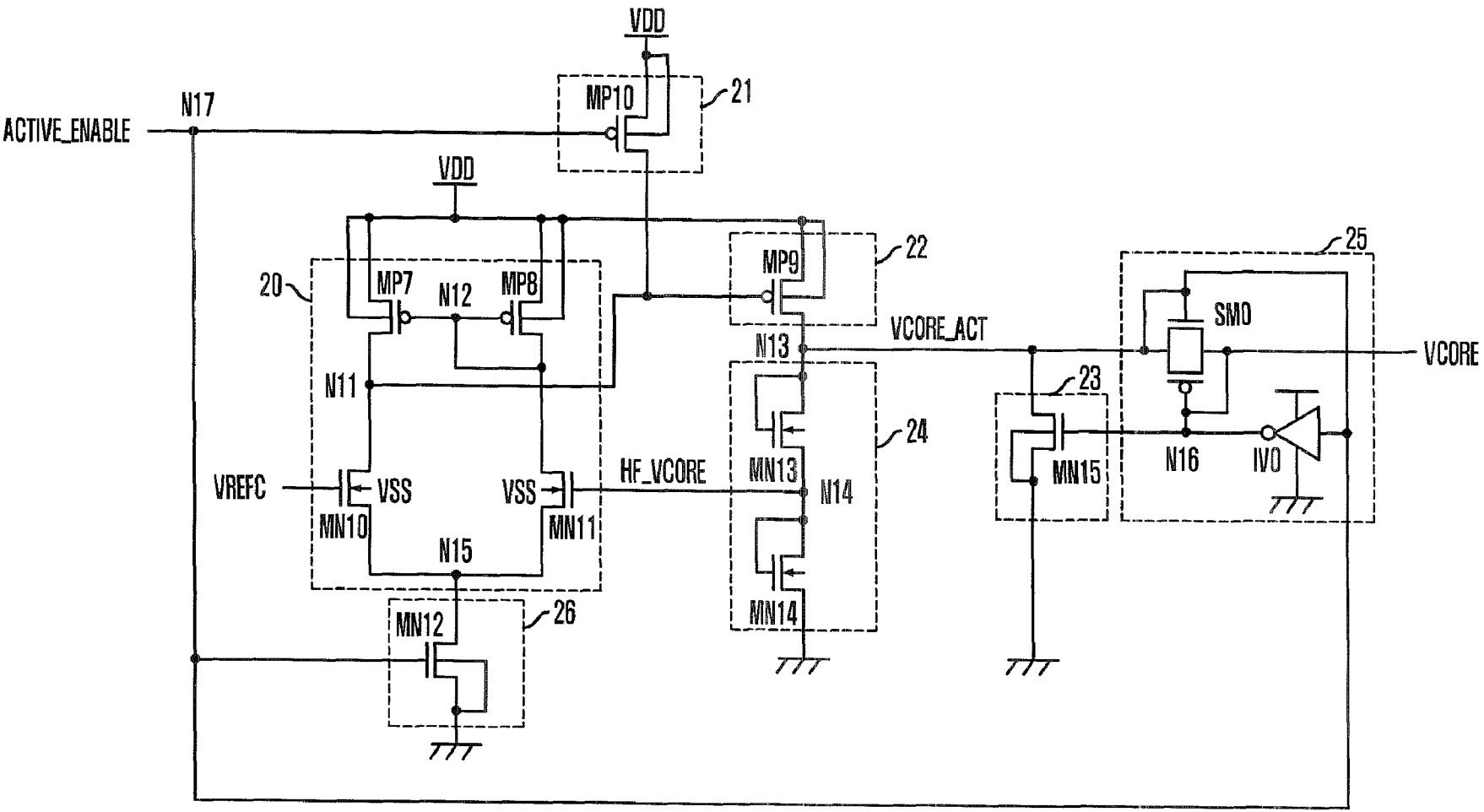
FIG. 2 is a circuit diagram illustrating a core voltage generator in accordance with an embodiment of the present invention.

FIG. 2 is a circuit diagram illustrating a core voltage generator in accordance with an embodiment of the present invention.

Referring to FIG. 2, the core voltage generator includes a comparison unit 20, an amplification unit 22, a half core voltage generation unit 24, a first control switch unit 26, a mute unit 23, an output switch unit 25, and a second control switch unit 21. The comparison unit 20 compares a half core voltage HF_VCORE with a reference voltage VREFC. The half core voltage HF_VCORE has half the voltage level of a core voltage output terminal of the amplification unit 22, and the reference voltage VREFC has half the level of a target core voltage (1.5 V/2=0.75 V). The amplification unit 22 generates an amplified core voltage VCORE_ACT of about 1.5 V in response to an output signal of the comparison unit 20. The half core voltage generation unit 24 distributes the core voltage VCORE_ACT generated from the amplification unit 22 and generates the half core voltage HF_VCORE having half the voltage level of the core voltage output terminal so as to maintain the core voltage VCORE_ACT at a desired level. The first control switch unit 26 opens or closes a current path of the comparison unit 20 so as to operate the comparison unit 20 selectively. When the core voltage VCORE_ACT is not output, the mute unit 23 maintains the voltage level of the core voltage output terminal of the amplification unit 22 at a ground voltage level. The output switch unit 25 is disposed in the middle of a core voltage output line of the amplification unit 22 and selectively outputs the core voltage VCORE. When the core voltage VCORE is not output, the second control switch unit 21 controls switching operation of the amplification unit 22.

The comparison unit 20 includes two NMOS transistors MN10 and MN11 for comparing the reference voltage VREFC, which is applied from an external voltage source, with the half core voltage HF_VCORE having half the voltage level of the core voltage output terminal. Source terminals of the NMOS transistors MN10 and MN11 are connected to each other through a node N15. The reference voltage VREFC is applied to a gate terminal of the NMOS transistor MN10, and the half core voltage HF_VCORE is applied to a gate terminal of the NMOS transistor MN11. A drain terminal of the NMOS transistor MN10 is connected in series to a PMOS transistor MP7 through a node N11, and an external power supply voltage VDD is applied to a source terminal of the PMOS transistor MP7. A drain terminal of the NMOS transistor MN11 is connected in series to a PMOS transistor MP8. Gate and drain terminals of the PMOS transistor MP8 are connected in series to each other through a node N12. A gate terminal of the PMOS transistor MP7 is also connected to the node N12. The power supply voltage VDD is supplied to the source terminal of the PMOS transistor MP7.

The amplification unit 22 includes a PMOS transistor MP9. A gate terminal of the PMOS transistor MP9 is connected to the node N11, and the power supply voltage VDD is supplied to a source terminal of the PMOS transistor MP9. An amplified core voltage VCORE_ACT is output through a drain terminal of the PMOS transistor MP9.

The first control switch unit 26 includes an NMOS transistor MN12. A drain terminal of the NMOS transistor MN12 is connected to the node N15 of the comparison unit 20, and an active enable signal ACTIVE_ENABLE is supplied from node N17 to a gate terminal of the NMOS transistor MN12. A source terminal of the NMOS transistor MN12 is grounded.

The half core voltage generation unit 24 includes two NMOS transistors MN13 and MN14. The NMOS transistors MN13 and MN14 are connected in series between the ground and the core voltage output terminal (a node N13) of the amplification unit 22. The gate terminal of the NMOS transistor MN11 of the comparison unit 20 is connected to a node N14 between the NMOS transistors MN13 and MN14. A drain terminal of the NMOS transistor MN13 is connected to a gate terminal of the NMOS transistor MN13, and a drain terminal of the NMOS transistor MN14 is connected to a gate terminal of the NMOS transistor MN14. That is, the amplified core voltage VCORE_ACT is divided by the NMOS transistors MN13 and MN14. Therefore, the half core voltage HF_VCORE can be output from the half core voltage generation unit 24 to the NMOS transistor MN11 of the comparison unit 20 through the node N14 so as to turn on the NMOS transistor MN11. In other words, the NMOS transistor MN11 of the comparison unit 20 is turned on by a feedback loop.

The mute unit 23 includes an NMOS transistor MN15 connected between the ground and the node N13. The mute unit 23 is connected to the core voltage output terminal (the node N13) of the amplification unit 22 in parallel with the half core voltage generation unit 24. A gate terminal of the NMOS transistor MN15 is connected to a node N16 of the output switch unit 25.

The output switch unit 25 includes a switch SM0 and an inverter IV0. The switch SM0 is disposed in the middle of the core voltage output line connected to the node N13. The inverter IV0 is used to control switching operations of the switch SM0. The switch SM0 is a double switch that is turned on and off according to input and output signals of the inverter IV0 N16 connected to the node 16. In detail, when a high signal is input to the inverter IV0 and a low signal is output from the inverter IV0, the switch SM0 is turned on to output a core voltage VCORE. The active enable signal ACTIVE_ENABLE is input to the inverter IV0.

The second control switch unit 21 includes a PMOS transistor MP10. The active enable signal ACTIVE_ENABLE is input to a gate terminal of the PMOS transistor MP10, and the power supply voltage VDD is supplied to a source terminal of the PMOS transistor MP10. A drain terminal of the PMOS transistor MP10 is connected to the node N11.

An exemplary operation of the core voltage generator in accordance with an embodiment of the present invention will now be described.

First, the comparison unit 20 operates to generate a core voltage VCORE as follows. A high-level active enable signal ACTIVE_ENABLE is applied to the gate terminal of the NMOS transistor MN12 of the first control switch unit 26. Then, the NMOS transistor MN12 is turned on to form a current path for operating the comparison unit 20.

At this time, the NMOS transistor MN10 of the comparison unit 20 is turned on by a reference voltage VREFC, and thus the voltage level of the node N11 is reduced. Of course, since the NMOS transistor MN12 is turned on, the voltage level of the node N15 is also low.

The high-level active enable signal ACTIVE_ENABLE is also applied to terminals of the inverter IV0 and the switch SM0 of the output switch unit 25 simultaneously. The inverter IV0 inverts the high-level active enable signal ACTIVE_ENABLE to a low level signal and transfers the low level signal to the other terminal of the switch SM0. Then, the switch SM0 is turned on by the high-level active enable signal ACTIVE_ENABLE and the inverted low-level signal (i.e., the output switch unit 25 is turned on).

In this state, since the voltage level of the node N11 is low, the PMOS transistor MP9 of the amplification unit 22 is turned on so that an amplified core voltage VCORE_ACT can be applied to the node N13. The core voltage VCORE_ACT applied to the node N13 is output through the turned-on output switch unit 25.

While the core voltage VCORE_ACT is being output as described above, the low level signal output from the inverter IV0 is applied to the gate terminal of the NMOS transistor MN15 of the mute unit 23, and the high-level active enable signal ACTIVE_ENABLE is applied to the gate terminal of the PMOS transistor MP10 of the second control switch unit 21. Therefore, the NMOS transistor MN15 and the PMOS transistor MP10 are both turned off.

When the levels of drain voltages of the NMOS transistor MN12 and the NMOS transistor MN10 are reduced, the level of the amplified core voltage VCORE_ACT output from the PMOS transistor MP9 is increased.

Meanwhile, the half core voltage generation unit 24 including the NMOS transistors MN13 and MN 14 generates a half core voltage HF_VCORE by dividing the amplified core voltage VCORE_ACT. The half core voltage HF_VCORE is applied to the gate terminal of the NMOS transistor MN11. Thus, the NMOS transistor MN11 is turned on, and as a result, gate voltages of the PMOS transistors MP7 and MP8 are reduced.

Since the gate voltages of the PMOS transistors MP7 and MP8 are reduced, the PMOS transistors MP7 and MP8 are turned on, and thus the voltage level of the node N11 increases gradually. As a result, the voltage level of the gate terminal of the PMOS transistor MP9 connected to the node N11 increases gradually.

The PMOS transistor MP9 is turned on when a low level voltage is applied to the gate terminal of the PMOS transistor MP9. Therefore, since the voltage level of the gate terminal of the PMOS transistor MP9 increases, the core voltage VCORE_ACT output from the PMOS transistor MP9 is reduced. As a result, the half core voltage HF_VCORE input to the comparison unit 20 is reduced. The comparison unit 20 compares the reduced half core voltage HF_VCORE with the reference voltage VREFC. In this way, the comparison unit 20 repeats the comparison operation until the half core voltage HF_VCORE becomes equal to the reference voltage VREFC.

As explained above, when the active enable signal ACTIVE_ENABLE input to the core voltage generator has a high level (refer to IDD5B in FIG. 3), the amplified core voltage VCORE_ACT is generated from the core voltage generator. However, when the active enable signal ACTIVE_ENABLE has a low level as indicated by IDD2P in FIG. 3 (i.e., the active enable signal ACTIVE_ENABLE is in a disable state), the amplified core voltage VCORE_ACT is not generated.

In detail, the low-level active enable signal ACTIVE_ENABLE is applied to the gate terminal of the NMOS transistor MN12 of the first control switch unit 26, and thus, the NMOS transistor MN12 is turned off.

The low-level active enable signal ACTIVE_ENABLE is also applied to the gate terminal of the PMOS transistor MP10 of the second control switch unit 21, and thus, the PMOS transistor MP10 is turned on.

In addition, the low-level active enable signal ACTIVE_ENABLE is inverted to a high level signal by the inverter IV0, and the inverted high level signal is applied to the gate terminal of the NMOS transistor MN15 of the mute unit 23. Thus, the NMOS transistor MN15 is turned on.

In addition, the low-level active enable signal ACTIVE_ENABLE is applied to one side of the switch SM0 of the output switch unit 25, and the inverted high level signal is applied to the of the other side of the switch SM0. Thus, the switch SM0 is turned off.

That is, the low level active enable signal ACTIVE_ENABLE turns off the first control switch unit 26, turns on the second control switch unit 21, turns off the output switch unit 25, and turns on the mute unit 23.

When the NMOS transistor MN12 is turned off, a current path is not formed through the NMOS transistor MN10. That is, the NMOS transistor MN10 is turned off. In this case, the voltage level of the node N11 becomes high, and thus, the PMOS transistor MP9 of the amplification unit 22 is turned off.

Although the PMOS transistor MP9 is turned off, a small amount of current can flow through the PMOS transistor MP9 due to inherent characteristics of the PMOS transistor MP9 as described above. Thus, the small amount of current can further flow through the NMOS transistors MN13 and MN14 of the half core voltage generation unit 24.

However, since the NMOS transistor MN15 of the mute unit 23 is turned on, the voltage level of the node N13 can be kept at the ground voltage level. That is, the amplified core voltage VCORE_ACT can be kept at a zero-volt state. Therefore, the current flow through the NMOS transistors MN13 and MN14 of the half core voltage generation unit 24 can be prevented when the PMOS transistor MP9 is turned off.

Moreover, since the switch SM0 is turned off when the PMOS transistor MP9 is turned off, the output of the amplified core voltage VCORE_ACT can be surely interrupted.

In addition, since the second control switch unit 21 is turned on, the voltage level of the node N11 is high. The voltage level difference between the gate and source terminals of the PMOS transistor MP9 can be minimized, and thus, the PMOS transistor MP9 can be turned off more reliably.

Figure 1:
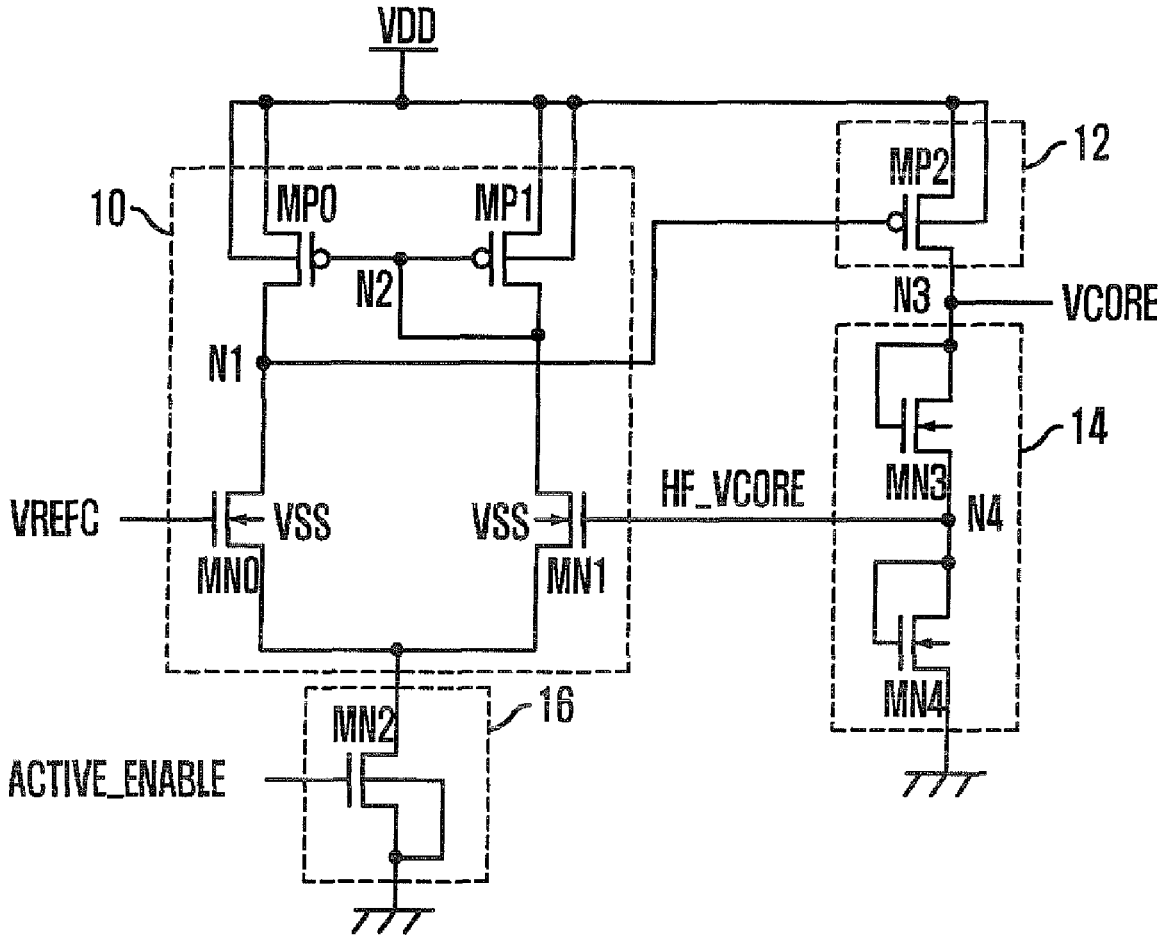
FIG. 1 (PRIOR ART)
FIG. 1 is a circuit diagram illustrating a conventional core voltage generator.
Figure 3:
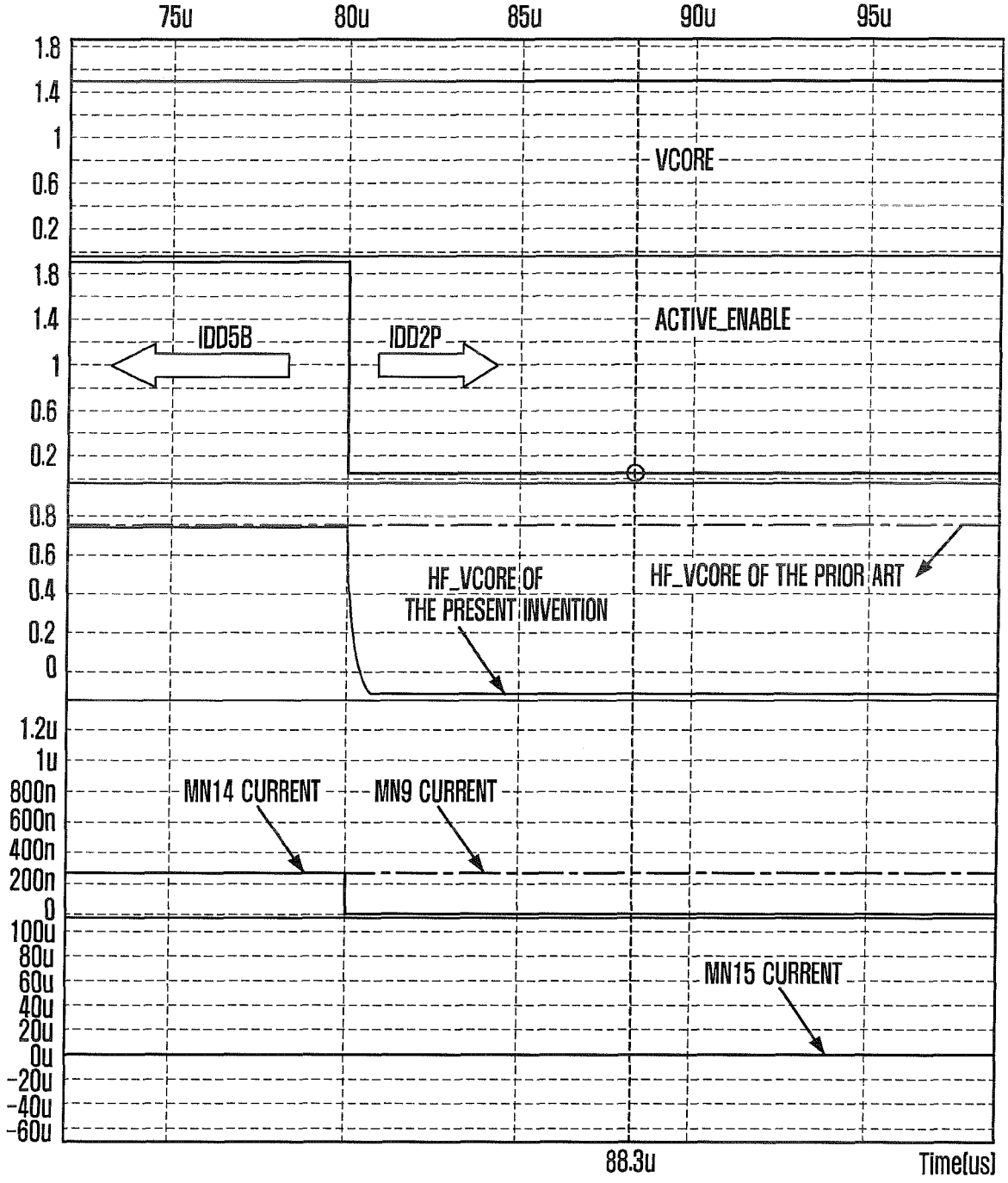
FIG. 3 is a graph illustrating operational characteristics of the core voltage generator in accordance with an embodiment of the present invention.

FIG. 3 is a graph showing results of a test performed on the core voltage generator in the conditions of an external power supply voltage VDD of 1.8 volts, a reference voltage VREFC of 0.75 volts, and an active enable signal voltage of 0.83 volts. Referring to FIG. 3, the amounts of current flowing through the NMOS transistors MN14 and MN15 are about 1/19 times the amount of current flowing through the conventional PMOS transistor MP2 (see FIG. 1)

As described above, the core voltage generator in accordance with the present invention is configured to reduce unnecessary power consumption when the core voltage generator does not generate a core voltage. To achieve this, when the generation of a core voltage is interrupted, the voltage level of the core voltage output terminal of the core voltage generator is kept at about a zero-voltage level so as to prevent power consumption through a current path of the half core voltage generation unit 24. Furthermore, the amplification unit 22 can be reliably turned off so as to prevent current leakage through the PMOS transistor MP9 of the amplification unit 22. Furthermore, the double switch SM0 is disposed at the core voltage output line so that the core voltage can be interrupted more reliably by turning off the switch SM0.

Therefore, in accordance with the present invention, when the generation of the core voltage is interrupted, a current flow through the core voltage output terminal of the core voltage generator can be prevented more reliably.

While the present invention has been described with respect to the specific embodiments, it will be apparent to those skilled in the art that various changes and modifications may be made without departing from the spirit and scope of the invention as defined in the following claims.

What is claimed is:

1. A core voltage generator, comprising:

a comparison unit configured to output a difference between a reference voltage and a feedback core voltage;

an amplification unit configured to output a core voltage by amplifying an external power supply voltage according to an output signal of the comparison unit;

a mute unit configured to maintain a voltage level of an output terminal of the amplification unit at a ground voltage level when the output of the core voltage is interrupted; and an output switch unit configured to output the core voltage and coupled to a core voltage output line of the amplification unit, wherein the amplification unit and the output switch unit are turned off when the output of the core voltage is interrupted, wherein the output switch unit comprises:

an inverter configured to invert an external control signal for interrupting the output of the core voltage; and a switch configured to be turned off in response to a high-level signal output from the inverter and a low-level control signal so as to disconnect the core voltage output line.

2. The core voltage generator as recited in claim 1, wherein the mute unit comprises a MOS transistor connected between ground and the output terminal of the amplification unit.

3. The core voltage generator as recited in claim 2, wherein the MOS transistor of the mute unit is an NMOS transistor.

4. The core voltage generator as recited in claim 3, wherein the NMOS transistor is turned on in response to an external control signal so as to interrupt the output of the core voltage.

5. The core voltage generator as recited in claim 1, further comprising a first control switch unit configured to control formation of a current path through the comparison unit based on an external control signal.

6. The core voltage generator as recited in claim 1, wherein the amplification unit comprises a MOS transistor, and the core voltage generator further comprises a second control switch unit configured to turn off the MOS transistor when the output of the core voltage is interrupted.

7. The core voltage generator as recited in claim 6, wherein the second control switch unit controls a gate voltage of the MOS transistor.

8. The core voltage generator as recited in claim 1, further comprising a half core voltage generation unit connected between ground and the output terminal of the amplification unit to generate the feedback core voltage.

* * * * *